US012584673B2

(12) United States Patent
Choi et al.

(10) Patent No.: US 12,584,673 B2
(45) Date of Patent: Mar. 24, 2026

(54) REFRIGERATOR

(71) Applicant: LG ELECTRONICS INC., Seoul (KR)

(72) Inventors: Sooyoung Choi, Seoul (KR); Jimin You, Seoul (KR)

(73) Assignee: LG Electronics Inc., Seoul (KR)

( * ) Notice: Subject to any disclaimer, the term of this patent is extended or adjusted under 35 U.S.C. 154(b) by 221 days.

(21) Appl. No.: 18/037,913

(22) PCT Filed: Nov. 19, 2021

(86) PCT No.: PCT/KR2021/017101
§ 371 (c)(1),
(2) Date: May 19, 2023

(87) PCT Pub. No.: WO2022/108390
PCT Pub. Date: May 27, 2022

(65) Prior Publication Data

US 2024/0003609 A1 Jan. 4, 2024

(30) Foreign Application Priority Data

Nov. 19, 2020 (KR) ..... 10-2020-0155754

(51) Int. Cl.
*F25C 1/246* (2018.01)

(52) U.S. Cl.
CPC ..... *F25C 1/246* (2013.01); *F25C 2300/00* (2013.01); *F25C 2400/14* (2013.01)

(58) Field of Classification Search
CPC .. F25C 1/246; F25C 2300/00; F25C 2400/14; F25C 5/22; F25C 1/24; F25D 2317/063;
(Continued)

(56) References Cited

U.S. PATENT DOCUMENTS 3,025,679 A * 3/1962 Keighley ..... F25C 1/24 62/353
3,320,759 A * 5/1967 Mathues ..... F25C 5/185 62/353

(Continued)

FOREIGN PATENT DOCUMENTS

AU 2010259495 A1 * 11/2011 ..... F25C 5/00
CA 2424837 C * 7/2007 ..... F25C 1/04

(Continued)

OTHER PUBLICATIONS

Extended European Search Report in European Appln. No. 21895158.0, mailed on Aug. 20, 2024, 8 pages.

*Primary Examiner* — Len Tran
*Assistant Examiner* — Kirstin U Oswald
(74) *Attorney, Agent, or Firm* — Fish & Richardson P.C.

(57) ABSTRACT

A refrigerator includes: a cabinet defining a storage space, a door that opens and closes the storage space, an evaporator generating cold air to thereby reduce a temperature of the storage space, a blowing fan circulating the cold air in the storage space, a grille panel provided at a rear side of the storage space and including a discharge port discharging the cold air into the storage space, and an ice maker disposed at a front side of the grille pan and including a guide duct guiding a flow of the cold air discharged from the discharge port. The guide duct provides a branched passage to thereby guide (i) a portion of the cold air discharged from the discharge port into the ice maker and (ii) remaining portions of the cold air to bypass the ice maker and into a space defined at a front side of the ice maker.

20 Claims, 12 Drawing Sheets

(58) Field of Classification Search
CPC ..... F25D 17/065; F25D 17/08; F25D 11/02; F25D 17/067; F25D 23/12; F25D 2317/061; F25D 2317/067; F25D 2323/021
USPC ..... 62/420
See application file for complete search history.

(56) References Cited

U.S. PATENT DOCUMENTS 6,438,988 B1 * 8/2002 Paskey ..... F25C 1/04 62/353
6,732,537 B1 * 5/2004 Anell ..... F25D 17/065 62/353
8,359,878 B2 * 1/2013 Kim ..... F25D 17/065 62/424
8,567,210 B2 * 10/2013 Park ..... F25D 17/065 62/425
8,789,388 B2 * 7/2014 Lee ..... F25D 17/065 62/425
8,943,852 B2 * 2/2015 Lee ..... F25D 17/062 62/425
9,341,402 B1 * 5/2016 Loudermilk ..... F25C 5/182
9,476,631 B2 * 10/2016 Park ..... F25C 5/22
10,101,074 B2 * 10/2018 Morgan ..... F25C 5/185
10,739,053 B2 * 8/2020 Jimenez ..... F25C 1/04
11,493,252 B2 * 11/2022 Olvera ..... F25D 17/065
2005/0061018 A1 * 3/2005 Kim ..... F25D 17/065 62/340
2007/0084229 A1 * 4/2007 Han ..... F25D 17/065 62/340
2008/0034779 A1 * 2/2008 Lee ..... F25C 1/04 62/344
2008/0034780 A1 * 2/2008 Lim ..... F25C 1/04 62/353
2008/0236187 A1 * 10/2008 Kim ..... F25C 1/04 62/344
2008/0264082 A1 * 10/2008 Tikhonov ..... F25C 1/04 62/425
2008/0295539 A1 * 12/2008 An ..... F25D 17/065 62/344
2009/0113920 A1 * 5/2009 Bae ..... F25D 17/065 62/426
2009/0113921 A1 * 5/2009 Bae ..... F25D 17/067 62/340
2010/0011786 A1 * 1/2010 Shin ..... F25C 1/04 62/73
2010/0031675 A1 * 2/2010 Kim ..... F25C 1/08 62/73
2010/0050681 A1 * 3/2010 Ryu ..... F25D 11/022 62/344
2010/0126185 A1 * 5/2010 Cho ..... F25C 5/22 62/344
2010/0313594 A1 * 12/2010 Lee ..... F25D 17/062 62/340
2010/0319387 A1 * 12/2010 Park ..... F25D 17/065 62/347
2011/0100046 A1 * 5/2011 Choi ..... F25D 23/069 62/320
2011/0146312 A1 * 6/2011 Hong ..... F25C 5/182 62/347
2012/0174613 A1 * 7/2012 Park ..... F25C 5/22 62/320
2013/0098097 A1 * 4/2013 Lee ..... F25C 1/00 62/340
2013/0264929 A1 * 10/2013 An ..... F25D 23/006 29/890.035
2016/0245574 A1 * 8/2016 Jeong ..... F25C 5/08
2016/0258663 A1 * 9/2016 Visin ..... F25C 1/246
2016/0370049 A1 * 12/2016 Yang ..... F25C 1/00
2016/0370063 A1 * 12/2016 Yang ..... F25C 1/25
2016/0370078 A1 * 12/2016 Koo ..... F25D 23/028
2016/0370087 A1 * 12/2016 Koo ..... F25D 17/065
2017/0292747 A1 * 10/2017 Yang ..... F25C 1/24
2017/0292749 A1 * 10/2017 Yang ..... F25C 1/25
2017/0292753 A1 * 10/2017 Yang ..... F25C 5/22
2017/0292771 A1 * 10/2017 Yang ..... F25D 17/065
2017/0292773 A1 * 10/2017 Yang ..... F25D 11/02
2017/0307275 A1 * 10/2017 McCollough ..... F25C 5/08
2017/0307281 A1 * 10/2017 Morgan ..... F25C 5/185
2017/0314832 A1 * 11/2017 Kim ..... F25C 5/22
2017/0321946 A1 * 11/2017 Kim ..... F25C 5/22
2018/0017307 A1 * 1/2018 Jeong ..... F25C 1/24
2018/0164018 A1 * 6/2018 Park ..... F25C 5/22
2018/0313593 A1 * 11/2018 Olvera ..... F25D 17/08
2018/0335240 A1 * 11/2018 Jeong ..... F25C 5/22
2019/0101316 A1 * 4/2019 Hong ..... F25C 1/24
2019/0264972 A1 * 8/2019 Kim ..... F25D 17/065
2019/0293335 A1 * 9/2019 Bertolini ..... F25C 1/04
2020/0232697 A1 * 7/2020 Galea ..... F25C 1/04

FOREIGN PATENT DOCUMENTS

CN 111829277 A * 10/2020 ..... F25D 11/022
DE 102006061100 A1 * 6/2008 ..... F25C 1/00
DE 102008024499 A1 * 12/2008 ..... F25D 17/065
DE 102008044178 A1 * 6/2010 ..... F25C 1/04
DE 102008044179 A1 * 6/2010 ..... F25C 1/04
DE 102014221717 A1 * 4/2016 ..... F25D 17/065
EP 2144023 A1 * 1/2010 ..... A23B 7/0425
EP 2159516 A2 * 3/2010 ..... F25C 1/00
EP 2447631 A2 * 5/2012 ..... F25C 5/06
EP 2520878 A2 * 11/2012 ..... F25B 49/00
EP 2818811 A2 * 12/2014 ..... F25D 17/062
EP 3106787 A1 * 12/2016 ..... F25C 1/25
EP 3106789 A1 * 12/2016 ..... F25C 1/24
EP 3106790 A1 * 12/2016 ..... F25C 1/24
EP 3270078 A2 * 1/2018 ..... F25C 1/18
EP 3361194 A1 * 8/2018 ..... F25C 1/20
EP 3483533 A2 * 5/2019 ..... F25C 5/22
EP 3653975 A1 5/2020
EP 3693688 A2 * 8/2020 ..... F25D 17/065
JP H06300433 A * 10/1994
JP 09033155 A * 2/1997
JP H11148763 A * 6/1999
JP H11173736 A * 7/1999
JP 2003172564 A * 6/2003
JP 3903066 B1 * 4/2007 ..... F25D 17/08
JP 4480518 B2 * 6/2010
JP 2015068509 4/2015
JP 2017072336 A * 4/2017 ..... F25D 23/00
KR 200152099 Y1 * 7/1999 ..... F25D 17/065
KR 597676 B1 * 7/2006
KR 100597676 7/2006
KR 100597676 B1 * 7/2006 ..... F25C 5/22
KR 20070060504 A * 6/2007 ..... F25D 17/065
KR 20080001004 A * 1/2008 ..... F25C 1/24
KR 20080014598 A * 2/2008 ..... F25D 23/00
KR 20080061180 A * 7/2008 ..... F25C 1/24
KR 100853423 B1 * 8/2008 ..... F25D 21/14
KR 20080106688 A * 12/2008 ..... F25C 5/22
KR 20100013724 2/2010
KR 20110044350 4/2011
KR 20110044350 A * 4/2011 ..... F25D 13/04
KR 20120124324 A * 11/2012 ..... F25C 5/02
KR 101395120 B1 * 5/2014 ..... F25D 23/00
KR 101754374 B1 * 7/2017 ..... F25C 1/24
KR 20190100119 8/2019
TW 201809562 A * 3/2018 ..... F25D 23/00
WO WO-2009096651 A1 * 8/2009 ..... F25D 17/065
WO WO-2010058888 A2 * 5/2010 ..... F25C 1/10
WO WO-2014198153 A1 * 12/2014 ..... F25D 17/062
WO WO-2017176073 A2 * 10/2017 ..... F25C 1/24

* cited by examiner

REFRIGERATOR

CROSS-REFERENCE TO RELATED APPLICATIONS

This application is a National Stage application under 35 U.S.C. 371 of International Application No. PCT/KR2021/017101, filed on Nov. 19, 2021, which claims the benefit of Korean Patent Application No. 10-2020-0155754, filed on Nov. 19, 2020. The disclosures of the prior applications are incorporated by reference in their entirety.

FIELD

The present disclosure relates to a refrigerator.

DESCRIPTION OF RELATED ART

In general, a refrigerator is a home appliance that allows food to be stored at a low temperature in an internal storage space shielded by a refrigerator door. The refrigerator is constructed to keep the stored food in an optimal condition by cooling the inside of the storage space using cold air generated via heat exchange with a refrigerant circulating in a refrigeration cycle.

Such refrigerators are gradually becoming larger and more multifunctional in accordance with a trend of changing dietary habits and upgrading products, and refrigerators with various structures and convenience devices in consideration of user's convenience are being released.

In particular, recently, there is a refrigerator equipped with an automatic ice maker capable of automatically making and storing ice.

Representatively, Korean Patent No. 10-2010-013724 discloses a structure in which the ice maker is disposed in a freezing compartment, and ice is made by automatically supplied water and then dropped downward to be stored.

However, in a refrigerator with such structure, when the storage space is defined in a freezing compartment door, there is a problem in that supply of cold air is blocked by the ice maker and supply of cold air to a space in front of the ice maker is not smooth.

In addition, when a recessed accommodation space is defined in a bottom surface of a refrigerating compartment disposed on top of the freezing compartment, because a position of the recessed storage space overlaps an arrangement position of the ice maker, there is a problem in that a thickness of a portion between the refrigerating compartment and the freezing compartment is inevitably increased to maintain an insulation performance. In general, the refrigerator is the home appliance that allows the food to be stored at the low temperature in the internal storage space shielded by the refrigerator door, and is constructed to keep the stored food in the optimal condition by cooling the inside of the storage space using the cold air generated via the heat exchange with the refrigerant circulating in the refrigeration cycle.

DISCLOSURE

Technical Purpose

An embodiment of the present disclosure is to provide a refrigerator in which cold air circulation inside a freezing compartment is improved while satisfying a cooling performance of an ice maker at the same time.

An embodiment of the present disclosure is to provide a refrigerator capable of effectively supplying cold air to a door basket via an ice maker.

An embodiment of the present disclosure is to provide a refrigerator that prevents deterioration of an insulation performance and loss of internal volume by arranging a storage space in a bottom surface of a refrigerating compartment and an ice maker so as not to overlap each other.

Technical Solution

A refrigerator according to an embodiment of the present disclosure includes: a cabinet for defining a storage space therein; a door for opening and closing an open front surface of the storage space; an evaporator for generating cold air for cooling the storage space; a blowing fan for circulating cold air in the storage space; a grille pan for forming a rear surface of the storage space, and having a discharge port defined therein for discharging cold air into the storage space; and an ice maker disposed in front of the grille pan, the ice maker has a guide duct for guiding a flow of cold air discharged from the discharge port, and a branched passage is formed in the guide duct, so that a portion of cold air discharged from the discharge port is guided into the ice maker, and the remaining portion of cold air bypasses the ice maker and is guided to a space located in front of the ice maker.

The guide duct may be disposed between a top surface of the storage space and a top surface of the ice maker, so that a branch passage bypassing the ice maker may be formed above the ice maker.

A top cover with at least a portion thereof recessed upward may be disposed on the top surface of the storage space, and the top cover may form the branch passage by shielding an open top surface of the guide duct.

An inlet of the guide duct may be opened toward the discharge port, an outlet of the guide duct may be opened toward a rear surface of the door, and may include a plurality of outlets arranges so as to be vertically spaced apart from each other, and at least one of the plurality of outlets of the guide duct may be opened toward a door basket disposed on the rear surface of the door.

The ice maker may include a casing for forming an outer appearance of the ice maker, an upper tray disposed inside the casing and forming upper portions of multiple cells, and a lower tray rotatably mounted inside the casing and forming lower portions of the multiple cells, the upper tray and the lower tray may form the spherical cells in a state of being coupled to each other, and the guide duct may be coupled to the casing and shield an open top surface of the casing.

A casing outlet in communication with the branched passage of the guide duct and discharging cold air guided via the passage toward the door may be defined in a front surface of the casing.

The guide duct may include a duct plate for shielding the ice maker from above, and a guide wall extending in a front and rear direction along the duct plate to form the passage, and the passage may include an upper passage for guiding cold air to a door basket by the guide wall and a top surface of the duct plate, and a lower passage for guiding cold air to the ice maker by the guide wall and a bottom surface of the duct plate.

A cutout may be defined in the guide duct for a water supply member for supplying water to the ice maker to be disposed, and the guide wall may be formed on both sides of the cutout, so that the passage may be further branched to both sides of the cutout.

The guide wall may include a pair of inner walls extending by passing through both side surfaces of the cutout and coming into contact with each other after passing through the cutout, and outer walls disposed on both sides of the inner walls and extending in a state of being spaced apart from the inner walls, and rear ends of the inner wall and the outer wall may be partitioned vertically by the duct plate, and define inlets of the upper passage and lower passage.

The guide duct may include a first duct outlet opened at a front end of the duct plate and discharging cold air forward, and a second duct outlet vertically extending through the duct plate and discharging cold air downward, and the ice maker may have a casing guide connected to the second duct outlet and guiding discharged cold air toward the door basket disposed on the door.

Technical Effect

Following effects may be expected from the refrigerator according to the proposed embodiment.

In the refrigerator according to the embodiment of the present disclosure, the ice maker has the guide duct, and a portion of the cold air discharged from the rear of the guide duct is supplied to the ice maker and the rest is branched toward the rear surface of the freezing compartment door at the front, so that the supply of the cold air inside the freezing compartment may be smooth and uniform.

In particular, when the door basket is disposed on the freezing compartment door, the air that has passed through the ice maker may be directed to the door basket, so that the cooling performance of the door basket may be improved.

In addition, even in the structure in which the ice maker covers the discharge port, the cold air that has bypassed the ice maker by the guide duct may be sufficiently supplied to the door basket and the cooling performance may be guaranteed.

In addition, the casing outlet is defined in the front surface of the casing, and the outlet of the guide duct is defined above the casing outlet. Therefore, the cold air may be discharged from the front surface of the ice maker and the front surface of the guide duct, so that the cold air may be evenly transferred over a wide area of the freezing compartment door.

In addition, because the casing outlet has the structure extending vertically, there is the advantage in that the cold air may be smoothly supplied into the door basket located slightly downwardly of the ice maker.

In addition, the upper passage inlet and the lower passage inlet defined at the rear end of the guide duct facing the discharge port may have the structure branched to both left and right sides, and may have the arrangement that does not interfere with the central water supply member. Therefore, there is the advantage in that the even supply of the cold air to the multiple of cells may be ensured even when the ice maker is horizontally disposed.

In particular, outer ends of the respective lower passages toward the ice maker may correspond to or may be located slightly outwardly of the outer ends of the respective multiple cells arranged in succession in the horizontal direction in the ice maker, so that the cold air supplied via the lower passages may be supplied smoothly to all of the cells.

In addition, the ice maker may be disposed on the bottom surface of the barrier that divides the refrigerating compartment and the freezing compartment from each other, and may have the horizontally arranged structure extending in the left and right direction so as not to overlap the accommodation portion recessed from the top surface of the barrier, that is, the bottom surface of the refrigerating compartment.

That is, as the ice maker is disposed horizontally, the ice maker may be prevented from interfering with the accommodation portion defined at the front portion of the bottom surface of the refrigerating compartment, and thus the insulation performance of the barrier may be maintained, so that the barrier may be prevented from becoming thick.

In addition, as the ice maker has the arrangement structure that does not interfere with the accommodation portion defined in the bottom surface of the refrigerating compartment disposed above, the thickness of the barrier that divides the refrigerating compartment and the freezing compartment from each other may be maintained, so that the loss of the volume of the storage space may be prevented.

In addition, because the ice maker and the accommodation portion are horizontally spaced apart from each other, a decrease in an insulation thickness of the barrier may be prevented and an excessive decrease in the insulation performance may be prevented.

In addition, to avoid the interference with the accommodation portion, the ice maker is disposed at a rear side close to the discharge port, and the ice maker is disposed in the horizontal direction to shield most of the discharge ports. Even in such state, the cold air may be smoothly supplied to the freezing compartment door via the guide duct, and the cooling performance may be secured in the area of the freezing compartment door or the door basket.

In addition, at least a portion of the top surface of the freezing compartment in which the ice maker is mounted may be recessed, defining the space in which the guide duct is disposed. Accordingly, the space occupied by the guide duct and the ice maker inside the freezing compartment may be reduced, and the loss of the storage space in the freezing compartment due to the arrangement of the ice maker may be minimized. Furthermore, there is the advantage that the cold air may be smoothly supplied to the freezing compartment door that is covered by the ice maker.

In addition, even when the top surface of the freezing compartment is partially thinned due to the arrangement of the guide duct and the ice maker, the cold air flowing between the top surface of the freezing compartment and the top surface of the ice maker may block penetration of heat from the outside, and the insulation performance of the freezing compartment may be prevented from deteriorating.

DETAILED DESCRIPTIONS

Hereinafter, a specific embodiment of the present disclosure will be described in detail with drawings. However, the present disclosure may not be limited to the embodiment in which the idea of the present disclosure is presented, and other degenerate inventions or other embodiments that fall within the scope of the present disclosure may be easily suggested by adding, changing, or omitting components.

Directions are defined prior to description. In the embodiment of the present disclosure, a direction in which a front surface of a door shown in FIG. 1 is facing may be defined as a forward direction, and, based on the front surface of the door, a direction toward a cabinet, a direction toward a floor on which a refrigerator is installed, and a direction away from the floor may be defined as a rearward direction, a downward direction, and an upward direction, respectively.

Figure 1:
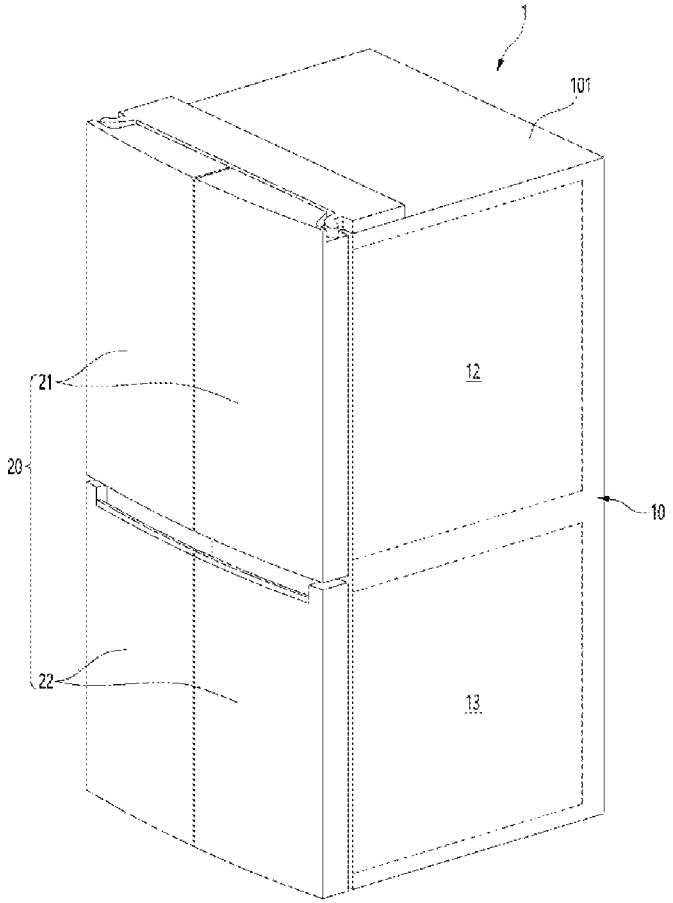
FIG. 1 is a perspective view of a refrigerator according to an embodiment of the present disclosure.
Figure 2:
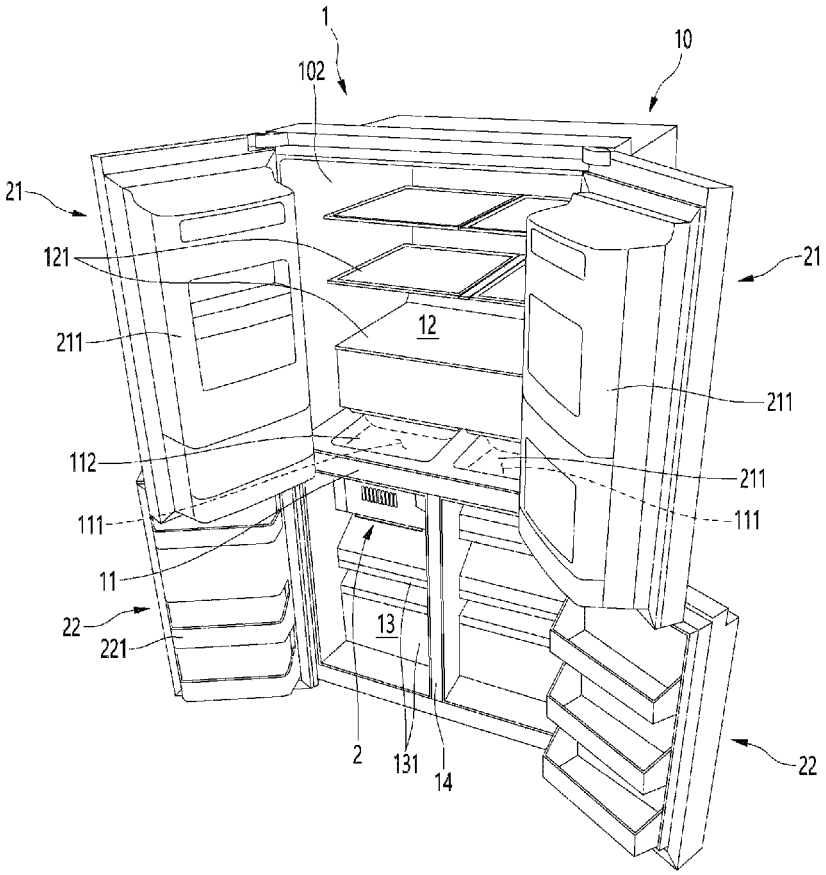
FIG. 2 is a perspective view in which doors of the refrigerator are opened.
Figure 3:
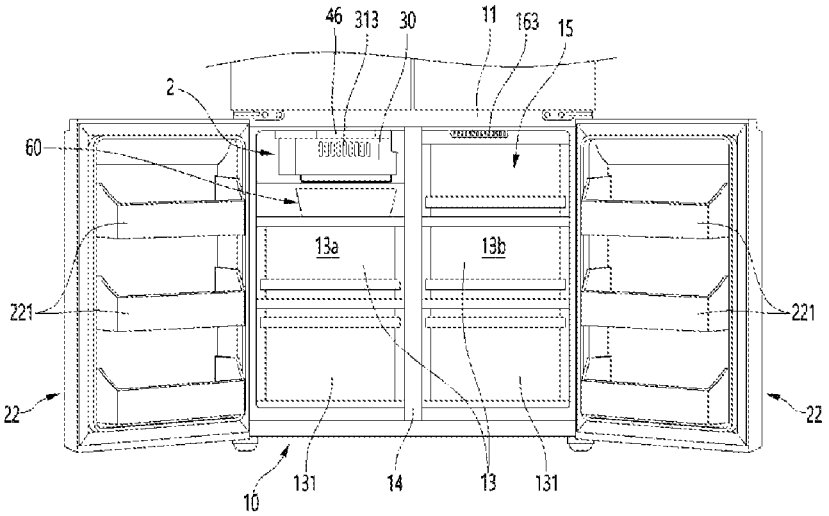
FIG. 3 is a front view in which lower doors of the refrigerator are opened.

FIG. 1 is a perspective view of a refrigerator according to an embodiment of the present disclosure. In addition, FIG. 2 is a perspective view in which doors of the refrigerator are opened. FIG. 3 is a front view in which lower doors of the refrigerator are opened.

As shown in the drawing, a refrigerator 1 according to an embodiment of the present disclosure may include a cabinet 10 for defining a storage space therein, and a door 20 that is mounted on an open front surface of the cabinet 10 to open and close the storage space.

The cabinet 10 may include an outer casing 101 for forming an outer appearance thereof, an inner casing 102 for defining the storage space therein, and an insulation material 103 filled between the outer casing 101 and the inner casing 102.

The cabinet 10 may include a barrier 11, and the storage space may be partitioned vertically by the barrier 11. Accordingly, the storage space may be divided into an upper storage space 12 and a lower storage space 13. For example, the upper storage space 12 may be used as a refrigerating compartment that is frequently used because it is easily accessible by a user, and the lower storage space 13 may be used as a freezing compartment. Accordingly, the upper storage space 12 may be referred to as a refrigerating compartment 12 and the lower storage space 13 may be referred to as a freezing compartment 13.

The door 20 may include an upper door 21 for shielding the upper storage space 12 and a lower door 22 for shielding the lower storage space 13. The upper door 21 may be referred to as a refrigerating compartment door 21, and the lower door 22 may be referred to as a freezing compartment door 22.

The upper door 21 may include a pair of upper doors, and the pair of upper doors may independently pivot to open and close the upper storage space 12. The upper door 21 may be of a French type and may partially open and close the upper storage space independently.

In addition, although not shown, when necessary, the upper door 21 may be constructed in a form of a double door composed of a main door having an opening defined therein and a sub door pivotably disposed in front of the main door to open and close the opening.

A door accommodation member 211 having a basket or a separate accommodation space may be further disposed on a rear surface of the upper door 21, that is, a surface facing the refrigerating compartment 12.

Like the upper door 21, the lower door 22 may include a pair of lower doors on both left and right sides, and the pair of lower doors may open and close the lower storage space 13. In addition, the lower door 22 may be referred to as the freezing compartment door 22.

In addition, a door basket 221 may be disposed on a rear surface of the lower door 22, that is, a surface facing the freezing compartment 13. Multiple door baskets 221 may be disposed so as to be spaced apart from each other vertically. In addition, the door basket 221 may be detachably provided. In addition, the door basket 221 may have a structure that may be accommodated by a shape of the rear surface of the lower door 22, rather than the detachable form.

A refrigerating compartment accommodation member 121 like a drawer and a shelf may be disposed inside the refrigerating compartment 12. Multiple refrigerating compartment accommodation members 121 may be disposed vertically, or may be disposed side by side on both left and right sides.

A recessed accommodation portion 111 may be further defined in a bottom surface of the refrigerating compartment 12. The accommodation portion 111 may be recessed downward in a top surface of the barrier 11, and an accommodation space may be defined in the space recessed by the storage portion 111, that is, a recessed area of the barrier 11. The accommodation portion 111 may be recessed, but may be recessed to a depth for a bottom surface of the barrier 11 corresponding to a position of the accommodating portion 111 not to protrude downward.

In addition, the accommodation portion 111 may be located at a front end of the bottom surface of the refrigerating compartment 12, and may be defined forwardly of the refrigerating compartment accommodation member 121 so as to be easily accessible by a user and so as not to be covered by the refrigerating compartment accommodation member 121. In addition, an accommodation portion cover 112 capable of opening and closing an open top surface of the accommodation portion 111 may be further disposed on the accommodation portion 111.

A freezing compartment accommodation member 131 may be disposed inside the freezing compartment 13. For example, the freezing compartment accommodation member 131 may be constructed as a drawer that may be retracted and extended, and multiple freezing compartment accommodation members may be disposed vertically. The retracting/extending structure of the freezing compartment accommodation member 131 may facilitate accommodation of food in the freezing compartment 13 located at a lower side.

The freezing compartment 13 may have a freezing compartment barrier 14 partitioning the freezing compartment 13 in a left and right direction. The freezing compartment barrier 14 may be disposed at a center of the freezing compartment 13 in a horizontal direction, and may extend from the bottom surface of the barrier 11 to a bottom surface of the freezing compartment 13. In addition, each space partitioned by the barrier 11 may be opened and closed by each of the pair of the freezing compartment doors 22.

An ice maker 30 may be disposed inside the freezing compartment 13. The ice maker 30 may be disposed on a top surface of the freezing compartment 13 and may be exposed forward when the freezing compartment door 22 is opened. The ice maker 30 may be disposed only in a space 13*a* on one side among spaces 13*a* and 13*b* on both left and right sides divided from each other in the freezing compartment 13.

The ice maker 30 may be constructed such that water supply, ice making, and icing are performed automatically, and may be referred to as an automatic ice maker. An ice bin 60 may be disposed below the ice maker 30. The ice bin 60 stores ice made by the ice maker 30 after being dropped. The ice bin 60 may be mounted on the freezing compartment accommodation member 131, and retracted and extended together with the freezing compartment accommodation member 131.

The ice maker 30 may make ice by supply of cold air inside the freezing compartment 13. Accordingly, the ice maker 30 may have a structure to which cold air is easily supplied.

For example, the ice maker 30 may be disposed such that a long side thereof faces forward, which may be expressed as being disposed in the horizontal direction. That is, in the state in which the ice maker 30 is mounted in the freezing compartment 13, a length in the left and right direction of the ice maker 30 may be greater than a length in a front and rear direction of the ice maker 30.

Hereinafter, an internal structure of the freezing compartment 13 will be described in more detail with reference to drawings.

Figure 4:
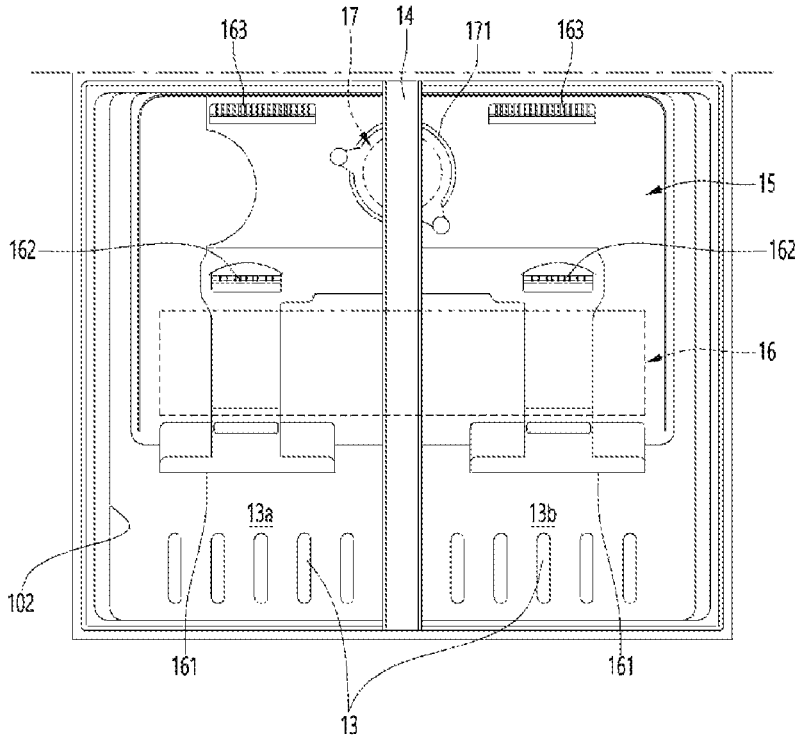
FIG. 4 is a front view showing the inside of a lower storage space of the refrigerator.

FIG. 4 is a front view showing the inside of a lower storage space of the refrigerator.

As shown in the drawing, the freezing compartment 13 may be formed by the inner casing 102. In addition, at least a portion of a rear surface of the freezing compartment 13 may be formed by a grille pan 15.

The grille pan 15 may be formed in a plate shape and may shield an evaporator 16 disposed at the rear. That is, the grille pan 15 may divide a space of the freezing compartment 13 formed by the inner casing 102 in the front and rear direction, and may define a space in which the evaporator 16 may be accommodated.

A space of the freezing compartment 13 in front of the grille pan 15 may be divided into the left space 13*a* and the right space 13*b* by the freezing compartment barrier 14. In this regard, the left space 13*a* and the right space 13*b* may be connected to each other in a state in which cold air may flow via the space at the rear of the grille pan 15. In one example, when necessary, the left space 13*a* and the right space 13*b* may have a structure capable of independent temperature adjustment.

A blowing fan 17 may be disposed above the evaporator 16. That is, cold air generated by the evaporator 16 may be supplied to the freezing compartment 13 by driving the blowing fan 17. The blowing fan 17 may be accommodated inside a fan guide 171, and the fan guide 171 may guide suction and discharge of cold air of the evaporator 16 to be effectively performed when the blowing fan 17 rotates. The blowing fan 17 and the fan guide 171 may be disposed at a center of the grille pan 15, and may be constructed such that cold air is supplied to each of the left space 13*a* and the right space 13*b*.

A suction port 161 and a discharge port 163 may be formed on the grille pan 15, cold air may be discharged into the freezing compartment 13 via the discharge port 163, and air inside the freezing compartment 13 may be sucked to a side of the evaporator 16 via the suction port 161.

In detail, the discharge port 163 may be located at an upper end of the grille pan 15 or at an upper portion close to the upper end. The discharge port 163 may include multiple discharge ports, and may be formed long in the horizontal direction. In particular, at least some of the discharge ports 163 may be located at positions facing the ice maker 30. For example, at least some of the discharge ports 163 may be located at positions facing inlets 431*a* and 432*a* of a guide duct 40, which will be described below, so that cold air may be smoothly supplied to the ice maker 30. In addition, when the freezing compartment door 22 is opened and the freezing compartment 13 is viewed from the front, the discharge port 163 may not be visible by being covered by the ice maker 30. In addition, the discharge port 163 may be disposed in each of the left space 13*a* and the right space 13*b*, or may be disposed at an approximate midpoint in the left and right direction.

An intermediate discharge port 162 may be further formed at an approximate midpoint of a vertical dimension of the grille pan 15. The intermediate discharge port 162 may be formed upwardly of an upper end of the evaporator 16 and downwardly of the ice maker 30. Accordingly, an area where the freezing compartment accommodation member 131 is disposed may be mainly cooled. The intermediate discharge port 162 may also be disposed in each of the left space 13*a* and the right space 13*b*, or may be disposed at an approximate midpoint in the left and right direction.

The suction port 161 may be formed at a lower end of the grille pan 15. The suction port 161 may be located at the position of the evaporator 16 or downwardly of the evaporator 16, and may be a passage through which the air inside the freezing compartment 13 is sucked. The suction port 161 may also be disposed in each of the left space 13*a* and the right space 13*b*, or may be disposed at an approximate midpoint in the left and right direction.

In addition, although not shown in detail, a flow guide structure for a flow of cold air generated by the evaporator 16 and distribution of the cold air to the left and right spaces may be further formed at the rear of the grille pan 15.

Hereinafter, an ice making device 2 disposed in the freezing compartment 13 will be described in more detail with reference to drawings.

Figure 5:
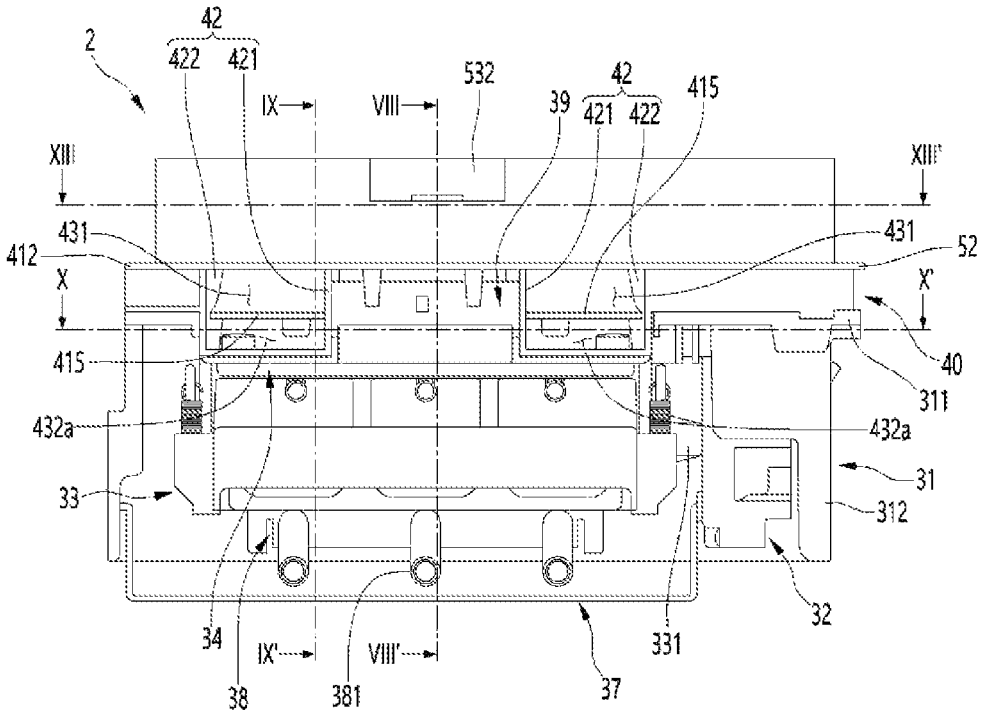
FIG. 5 is a rear view of an ice making device according to an embodiment of the present disclosure.
Figure 6:
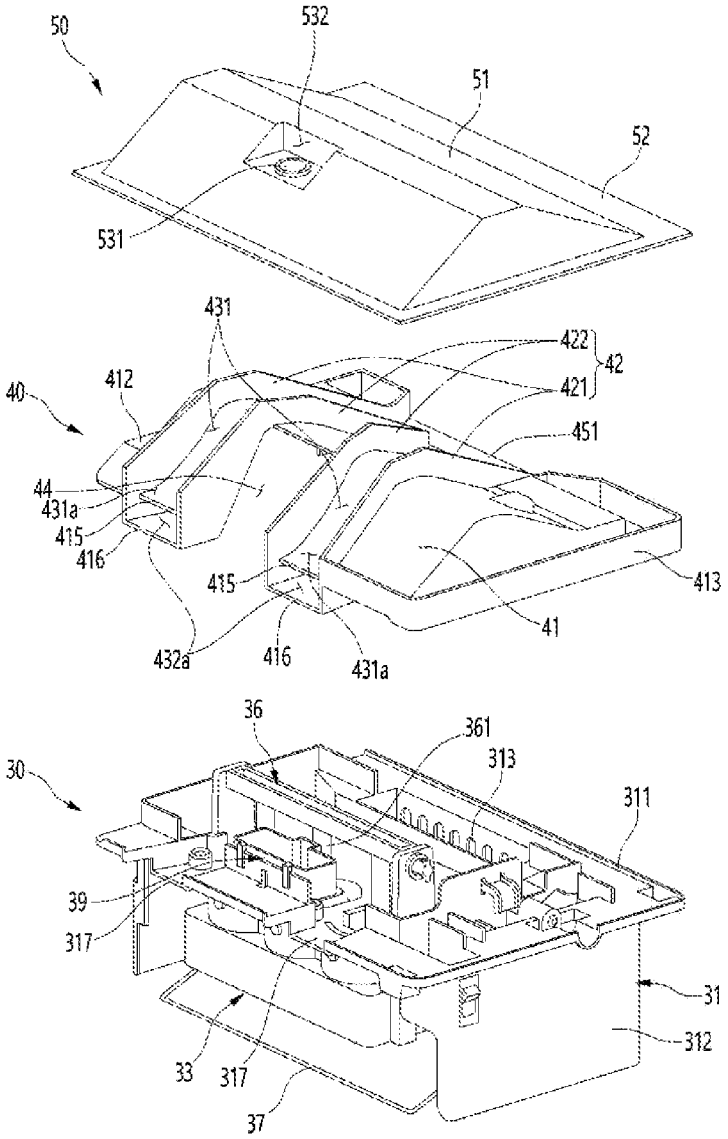
FIG. 6 is an exploded perspective view of the ice making device.
Figure 7:
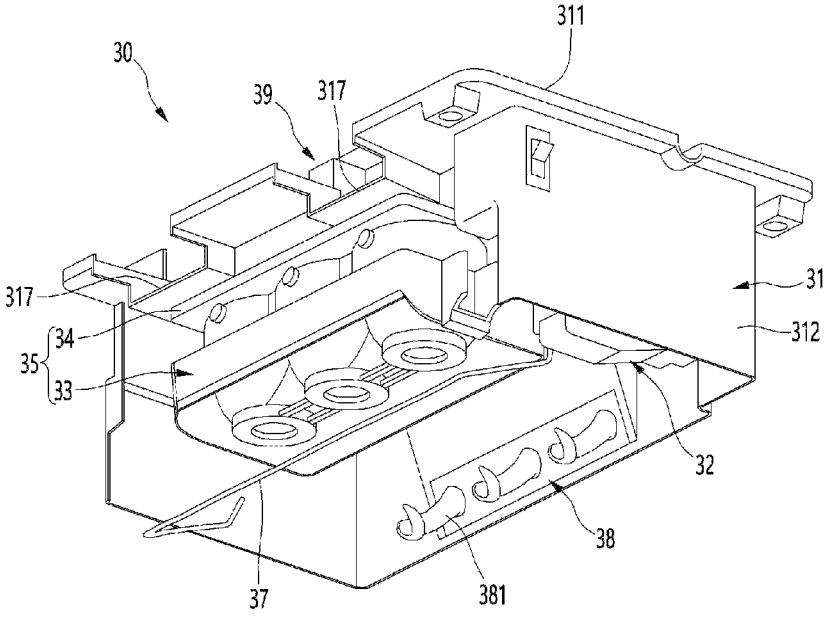
FIG. 7 is a rear-bottom perspective view of an ice maker, which is one component of the ice making device.
Figure 8:
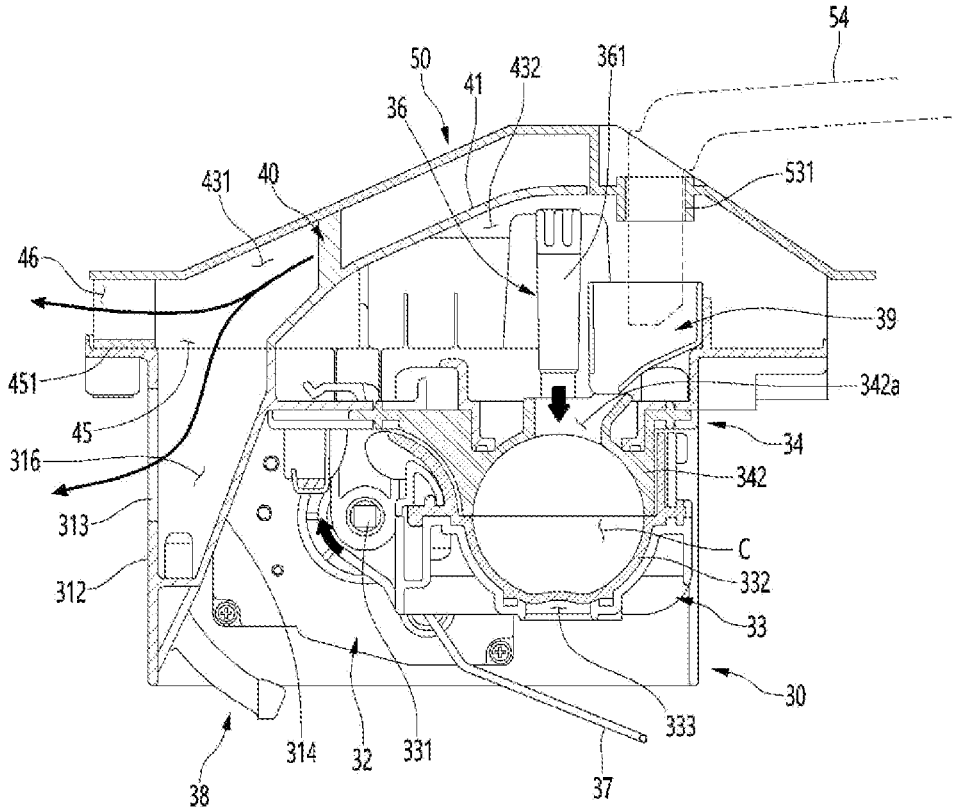
FIG. 8 is a cross-sectional view taken along a line VIII-VIII' in FIG. 5.
Figure 9:
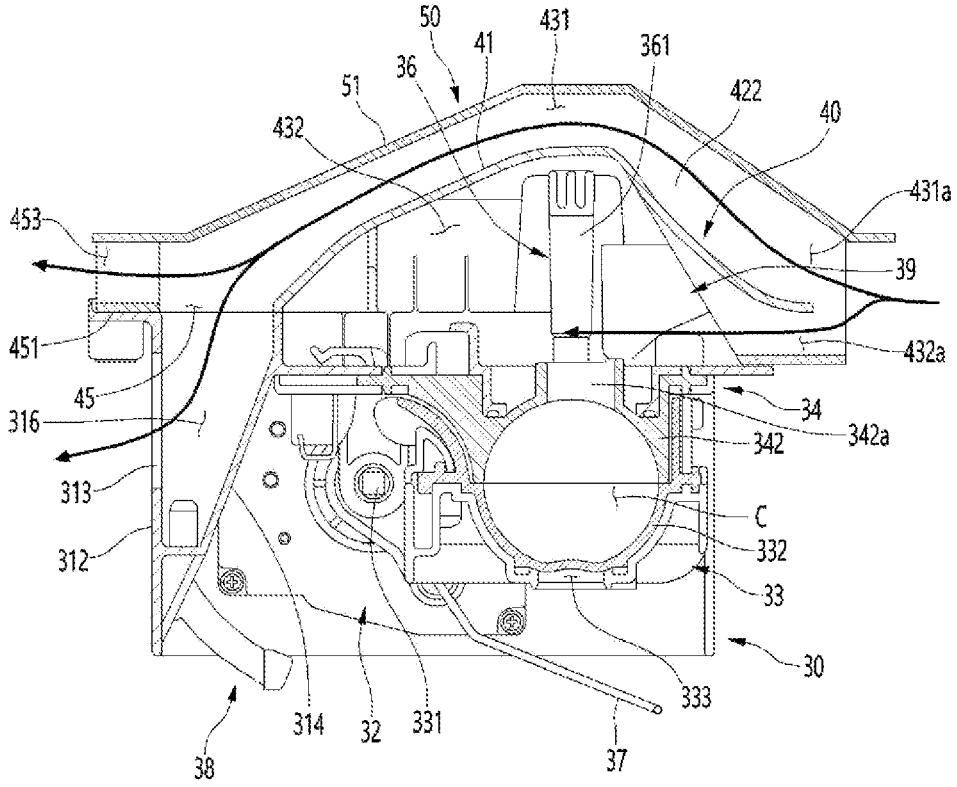
FIG. 9 is a cross-sectional view taken along a line IX-IX' in FIG. 5.
Figure 10:
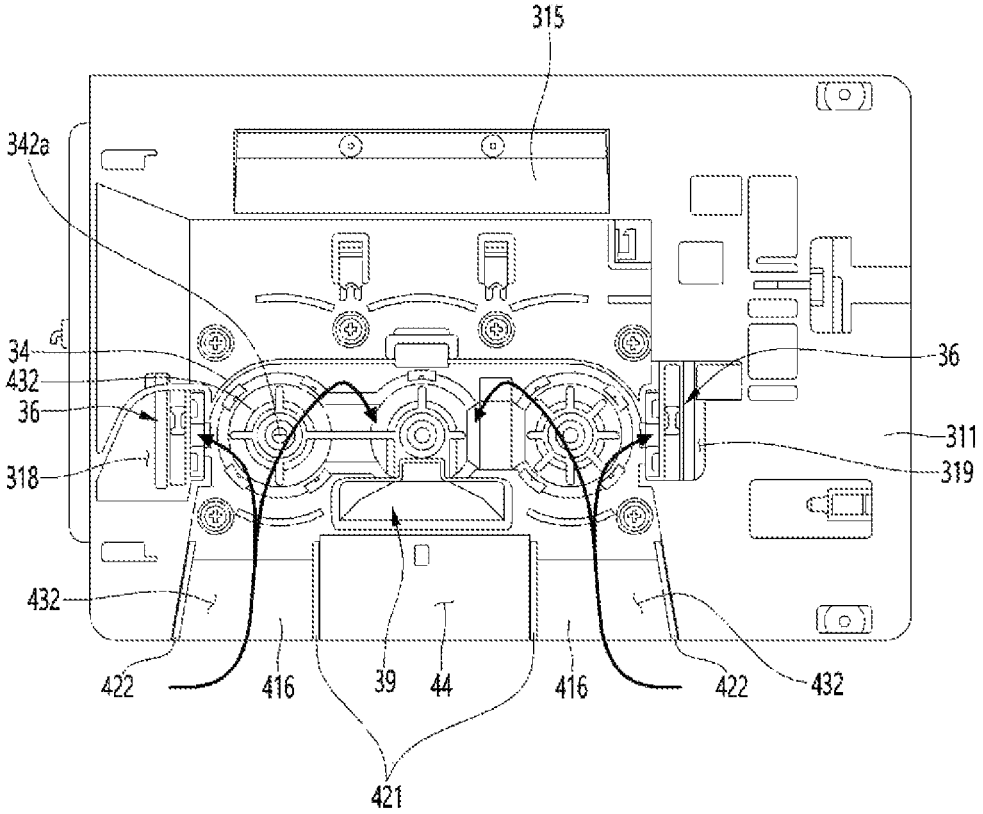
FIG. 10 is a cross-sectional view taken along a line X-X' in FIG. 5.

FIG. 5 is a rear view of an ice making device according to an embodiment of the present disclosure. FIG. 6 is an exploded perspective view of the ice making device. FIG. 7 is a rear-bottom perspective view of an ice maker, which is one component of the ice making device. In addition, FIG. 8 is a cross-sectional view taken along a line VIII-VIII' in FIG. 5. In addition, FIG. 9 is a cross-sectional view taken along a line IX-IX' in FIG. 5. In addition, FIG. is a cross-sectional view taken along a line X-X' in FIG. 5.

As shown in the drawing, the ice making device 2 may include the ice maker 30 for making ice and the guide duct 40 for supplying cold air toward the ice maker 30. The ice making device 2 may further include a top cover 50 coupled to the guide duct 40.

The ice maker 30 receives supplied water, makes ice, and then transfers the ice downward. The ice maker 30 may be an automatic ice maker in which the processes of supplying water, making ice, and transferring ice are automatically performed.

The ice maker 30 may include a casing 31 forming an outer appearance, an ice tray disposed inside the casing 31 and having multiple cells C in which water is accommodated to make ice, and a driver for rotating the ice tray 35. The ice maker 30 may further include an ejector 36 for removing the ice from the ice tray 35.

Each component of the ice maker 30 will be described in more detail. The casing 31 may be made of a plastic material, and may form the outer appearance of the ice maker 30, and at the same time, provide a space to accommodate the ice tray 35 therein.

The casing 31 may include a casing top surface 311 forming a top surface and a casing peripheral surface 312 extending downward along a perimeter of the casing top surface 311. The ejector 36 may transfer in the vertical direction on the casing top surface 311 to push and transfer the ice inside the cell C. In addition, the ice tray 35 and the driver 32 may be disposed inwardly of the casing peripheral surface 312.

The casing top surface 311 may form a surface that intersects the casing peripheral surface 312, and may extend outwardly of the casing peripheral surface 312. In addition, the perimeter of the casing top surface 311 may be coupled to a duct edge 412 of the guide duct 40. That is, the casing top surface 311 may be shielded by the guide duct 40.

An upper tray 34 for forming an upper portion of the ice tray 35 may be fixedly mounted on the casing top surface 311. The upper tray 34 may form an upper portion of the cell C. For example, the cell C may be formed in a spherical shape to make spherical ice, and multiple hemispherical grooves opening downward may be defined in a bottom surface of the upper tray 34.

A tray hole 342*a* may be defined at an upper end of the upper tray 34. The tray hole 342*a* may extend upward and not be covered with the casing top surface 311 so as to be exposed. The ejector 36 may enter and exit via the tray hole 342*a* to push and eject the ice made in the cell C.

At least one of the tray holes 342*a* may be connected to a water supply member 39 through which water is supplied, and may be a passage through which water for ice making is supplied to the multiple cells C. The water supply member 39 may be formed in a cup shape with an open top surface, and a water supply pipe 54 introduced into the barrier 11 may be disposed above the water supply member 39. The water supply member 39 may allow water to be supplied to a cell disposed in the middle among the multiple cells C, and may be disposed in the middle based on a horizontal length, that is, a length in the left and right direction, of the ice tray 35.

In addition, the ice tray 35 may include a lower tray 33 disposed beneath the upper tray 34 to form a lower portion of the ice tray 35. The lower tray 33 may be coupled to the upper tray 34 to form a lower portion of the cell C. Accordingly, multiple hemispherical grooves opening upward may be defined in a top surface of the lower tray 33.

The multiple cells C may be formed by the upper tray 34 and the lower tray 33, and the multiple cells may be disposed in succession in the horizontal direction. That is, an arrangement direction of the cells C may be continuous in the left and right direction when viewed from the front, and the arrangement direction of the cells C may be a direction intersecting a flow direction of the cold air discharged from the discharge port 163.

The lower tray 33 may be rotatably mounted on the driver 32. A rotation shaft 331 of the lower tray 33 may be coupled to the driver 32, and the lower tray 33 may rotate to open the cell C to allow the made ice to fall. In this regard, the rotation shaft 331 may extend in the left and right direction, and may extend in the same direction as a length direction of the ice tray 35.

In one example, at least a portion of each of the upper tray 34 and the lower tray 33 may be made of a material that is elastically deformable such as rubber or silicone so as to have each of an upper body 342 and a lower body 332. For example, the upper body 342 and the lower body 332 for at least forming the cell C of the upper tray 34 and the lower tray 33 may be made of a rubber or silicon material. Therefore, when the lower tray 33 comes into contact with the upper tray 34 by rotation, the upper body 342 and the lower body 332 come into close contact with each other to prevent water from leaking, and to make the ice transfer smoother. The remaining portions of the upper tray 34 and the lower tray 33 may be made of a plastic or metal material to provide a structure capable of being coupled to other components and operating.

Although not shown in detail, the driver 32 may be formed by a combination of a rotating motor and multiple gears for connecting the motor and the rotation shaft 331 to each other. The ejector 36 and a full ice detection device 37 to be described below may be connected to the driver 32, and the ejector 36 and the full ice detection device 37 may be operated by the operation of the driver 32.

The ejector 36 may be operated to transfer the ice made inside the cell C. The ejector 36 may be disposed on the top surface of the casing 31, and may be connected to the driver 32 to operate in association with the operation of the lower tray 33. Accordingly, when the ice making is completed and the lower tray 33 rotates, the cell C is opened, and an ejecting rod 361 passes through the tray hole 342*a* to push and eject the ice.

For the operation of the ejector 36, openings 318 and 319 may be defined on both sides of the top surface of the casing 31, and the ejector 36 may move vertically through the openings 318 and 319. In one example, the openings 318 and 319 may be defined such that cold air supplied toward the ice maker 30 may pass through the guide duct 40 to become a passage through which cold air is introduced into an inner space of the casing peripheral surface 312.

A lower ejector 38 may be further disposed inwardly of the casing peripheral surface 312. The lower ejector 38 may protrude inward from a front surface of the casing 31. In addition, a protruding end of the lower ejector 38 may be disposed within a radius of rotation of the lower casing 31 and extend to press one side of the lower casing 31, more specifically, a portion corresponding to one side of the cell C when the lower casing 31 is rotated.

Specifically, when the lower tray 33 is rotated to open the cell C, the ice is discharged by the ejector 36, but when the ice is positioned on the lower tray 33, the fixed lower ejector 38 is able to discharge the ice by pressing one side of the lower tray 33 corresponding to a lower portion of the cell C by the rotation of the lower tray 33. In this regard, a portion of the lower tray 33 in contact with the lower ejector 38 may be formed to be elastically deformable.

In one example, heaters may be further disposed in the upper tray 34 and the lower tray 33. The heaters may heat the upper tray 34 and the lower tray 33 such that the ice may be more easily removed from the cell C when the ice making is completed.

In one example, the full ice detection device 37 may be rotated below the lower tray 33, and both ends of the full ice detection device 37 may be coupled to the casing 31. The full ice detection device 37 may rotate based on the operation of the driver 32 such that ice located below the ice tray 35 may be detected.

That is, when the made ice accumulates to a vertical level equal to or greater than a certain vertical level in the ice bin 60 disposed below the ice tray 35, such state may be detected by the full ice detection device 37, and additional ice making operation of the ice maker 30 may be stopped.

A rear surface of the casing peripheral surface 312 may be open, and a front surface and both side surfaces excluding the rear surface thereof may extend downward from the casing top surface 311 to cover the ice tray 35 so as not to be exposed. In addition, a space opened downward and in which the ice tray 35 and the driver 32 may be disposed may be defined by the casing top surface 311 and the casing peripheral surface 312.

A casing outlet 313 may be defined in the casing peripheral surface 312. The casing outlet 313 may be defined in the front surface of the casing 31, that is, in the front surface of the casing peripheral surface 312. The casing outlet 313 may be defined to discharge a portion of the cold air branched and guided by the guide duct 40. In addition, the casing outlet 313 may extend downward from an upper portion of the casing peripheral surface 312. The casing outlet 313 may be formed to be long in the vertical direction, and may include multiple casing outlets arranged in succession in the left and right direction to have a shape like a grill.

Cold air may be discharged forward from a front area of the ice maker 30 via the casing outlet 313, and cold air may be effectively supplied to the door basket 221 on the rear surface of the freezing compartment door 22 facing the ice maker 30.

A casing guide 314 for guiding cold air discharged from the guide duct 40 toward the casing outlet 313 may be formed on the front surface of the casing 31. The casing guide 314 may be formed on an inner surface of the front surface of the casing, and may obliquely extend from below to above the casing outlet 313. That is, the casing guide 314 may define a portion of a front surface of the inner space of the casing 31, and may be inclined or rounded rearwardly while extending upwardly. Therefore, a casing passage 316 may be formed between the casing guide 314 and the front surface of the casing 31.

An upper end of the casing guide 314 may extend to the casing top surface 311, and the casing top surface 311 may have a casing inlet 315 in communication with the casing passage 316. Accordingly, cold air discharged from a second duct outlet 45 of the guide duct 40 may be introduced into the casing passage 316 via the casing inlet 315, and may be discharged through the casing outlet 313.

In one example, at a rear end of the casing top surface 311, a casing recessed portion 317 into which the inlet of the guide duct 40 may be seated may be defined. The casing recessed portions 317, as portions where the duct inlets 431*a* and 432*a* defined at a rear end of the guide duct 40 are seated, may be defined in a shape corresponding to the duct inlets 431*a* and 432*a*. Therefore, when the guide duct 40 and the casing 31 are coupled to each other, the casing 31 may be positioned at an accurate position.

In addition, a bottom surface of the casing depression 317 may be formed at a vertical level corresponding to the upper tray 34. Therefore, the cold air introduced from the guide duct 40 may effectively cool the upper tray 34 while passing through the top of the upper tray 34.

The casing recessed portions 317 may be disposed on both left and right sides of the water supply member 39, and both ends of the respective casing recessed portions 317 may be formed to face cells disposed at both side ends among the multiple cells C.

The guide duct 40 for guiding cold air supplied from the discharge port 163 may be mounted on the casing top surface 311. By the coupling of the guide duct 40 and the casing 31, an upper passage 431 and a lower passage 432 may be formed at an upper side and a lower side of the guide duct 40. The upper passage 431 may form a path through which cold air may flow toward the rear surface of the freezing compartment door 22, that is, toward the door basket 221 while bypassing the ice maker 30. In addition, the lower passage 432 may form a flow path of cold air that flows into the ice maker 30 and substantially cools the ice tray 35.

In addition, the top cover 50 may be disposed on a top surface of the guide duct 40. The top cover 50 may form the upper passage 431 by shielding the top surface of the guide duct 40. In addition, at the same time, the top cover 50 may be coupled to the bottom surface of the barrier 11 such that the ice making device 2 may be mounted on the bottom surface of the barrier 11. Therefore, the top cover 50 may be referred to as a mounting bracket.

Hereinafter, structures of the guide duct 40 and the top cover 50 that are not described will be described in more detail with reference to drawings.

Figure 11:
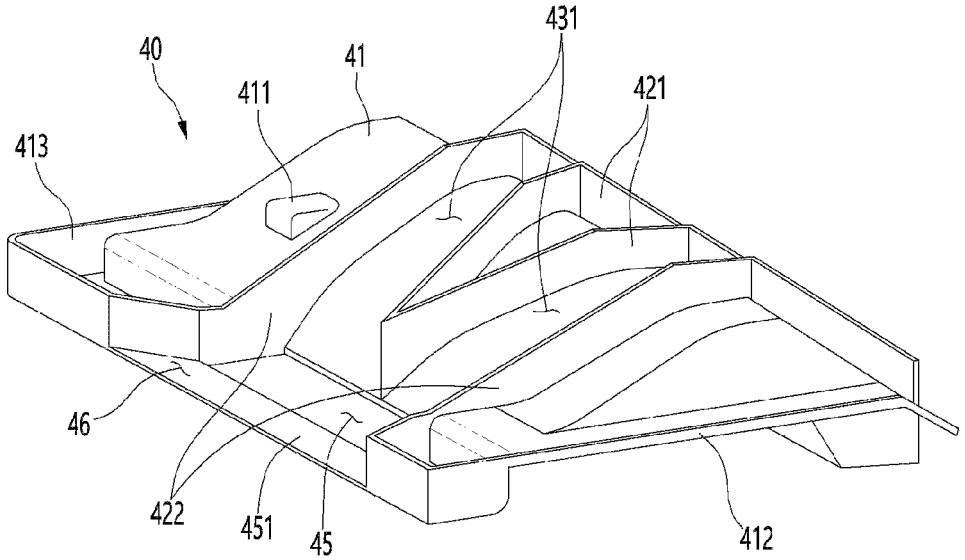
FIG. 11 is a front-top perspective view of a guide duct, which is one component of the ice making device.
Figure 12:
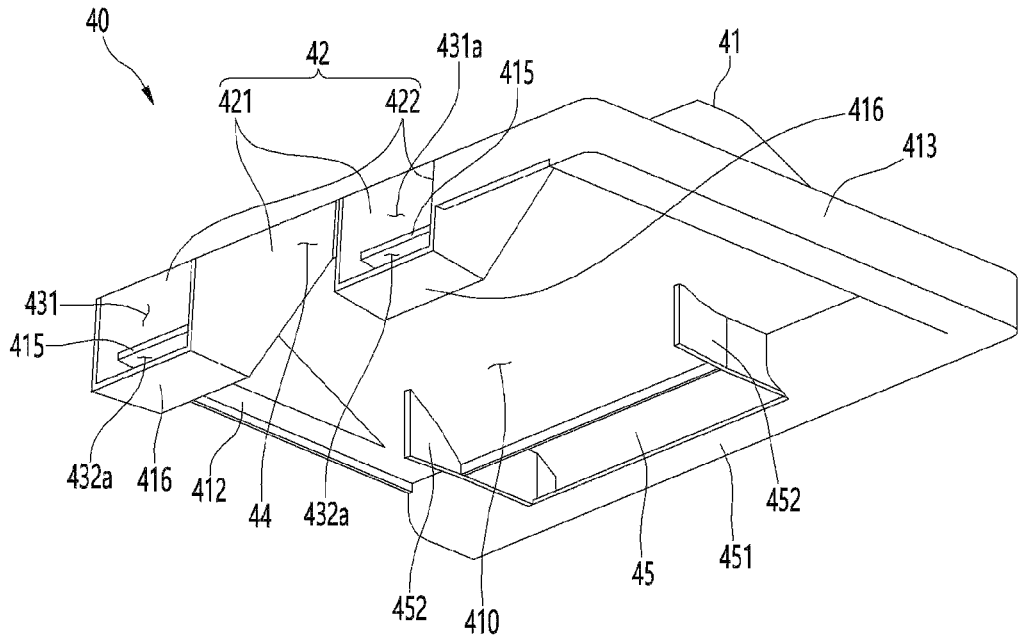
FIG. 12 is a rear-bottom perspective view of the guide duct.
Figure 13:
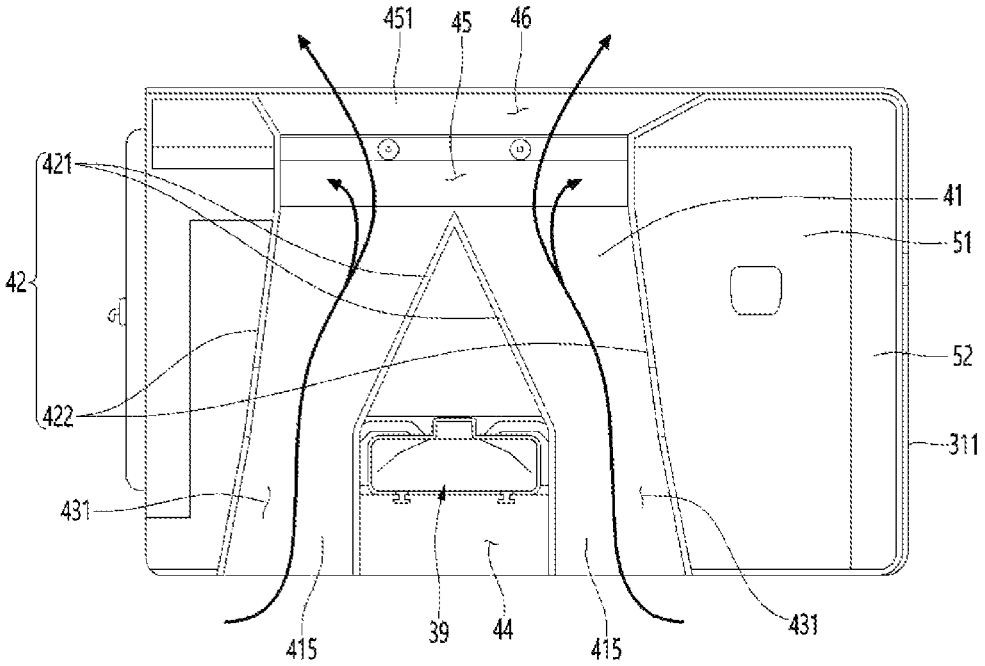
FIG. 13 is a cross-sectional view taken along a line XIII-XIII' in FIG. 5.

FIG. 11 is a front-top perspective view of a guide duct, which is one component of the ice making device. In addition, FIG. 12 is a rear-bottom perspective view of the guide duct. In addition, FIG. 13 is a cross-sectional view taken along a line XIII-XIII' in FIG. 5.

As shown in the drawing, the guide duct 40 may be coupled to the casing top surface 311 and may be constructed to shield a top surface of the ice maker 30 from above.

The guide duct 40 may be formed in a size corresponding to that of the casing top surface 311, and may be injection-molded with a plastic material to have a structure that shields the top surface of the ice maker 30, and simultaneously, forms the upper passage 431 and the lower passage 432.

In the guide duct 40, the upper passage 431 and the lower passage 432 may be formed by a duct plate 41 formed in an overall plate shape and a guide wall 42 extending in a direction intersecting the duct plate 41.

The duct plate 41 may be formed in the plate shape, and a central portion thereof may be formed in an upwardly protruding shape. In addition, left and right side surfaces of the duct plate 41 may extend downward to define a space 410 opened downward. The ejector 36 may be accommodated in the space beneath the duct plate 41, and may not be interfered while operating vertically.

In addition, a plate protrusion 411 may be further formed on the duct plate 41. The plate protrusion 411, which is to avoid interference with an arrangement structure of electric wires disposed on the top surface of the ice maker 30, may be formed to protrude upward.

As such, the duct plate 41 may shield the top surface of the ice maker 30 from above the ice maker 30 to partition the spaces where cold air may flow on the upper and lower sides from each other, and may have a structure to avoid interference with components that protrude from the top surface of the ice maker 30. For example, the duct plate 41 may have the central portion protruding upward and have downward slopes in the forward and rearward directions with respect to the central portion.

In addition, the duct edge 412 may be formed at a perimeter of the duct plate 41. The duct edge 412 may form a surface in contact with the casing top surface 311, and may come into close contact with the perimeter of the casing top surface 311. In addition, the duct edge 412 may be coupled to the casing top surface 311, and may allow the guide duct 40 to be coupled to the top surface of the ice maker 30.

A bent portion 413 extending upward may be formed at a perimeter of the duct edge 412, and may come in contact with the perimeter of the casing top surface 311, so that the guide duct 40 and the ice maker 30 may come into close contact with each other more firmly and leakage of cold air may be blocked.

A plate cutout 44 may be defined at a center of a rear end of the duct plate 41. When the guide duct 40 is coupled to the ice maker 30, the water supply member 39 may be positioned inside the plate cutout 44. Therefore, even when the guide duct 40 is mounted on the ice maker 30, the guide duct 40 may not interfere with the water supply member 39 and water may be smoothly supplied toward the cell C.

The guide wall 42 may be disposed on the duct plate 41. The guide wall 42 substantially forms the cold air passages in the guide duct 40. Branched passages may be formed in the guide duct 40 by the guide wall 42.

The guide wall 42 may be formed in the front and rear direction along the duct plate 41, and cold air may flow toward the ice maker 30 and the door basket 221 along the upper passage 431 and the lower passage 432 formed by the guide wall 42 and the duct plate 41.

Specifically, the guide wall 42 may extend forward from the rear end of the guide duct 40, and may be formed in a rib shape protruding in a direction perpendicular to the duct plate 41. In addition, the guide wall 42 may form the passages branched to both left and right sides by a pair of outer walls 421 and a pair of inner walls 422 inside the outer walls 421.

The inner walls 422 may be disposed so as to be spaced apart from each other on both left and right sides, and may extend from the rear end of the guide duct 40 along both left and right side ends of the cutout 44. In addition, the inner walls 422 may extend forward by passing through the cutout 44 and may extend to the second duct outlet 45 formed at a front end of the duct plate 41. In this regard, the pair of inner walls 422 may gradually come closer to each other while passing through the cutout 44, and may come into contact with and be connected to each other at a rear end of the second duct outlet 45.

In addition, the outer walls 421 may extend while being spaced apart from the pair of inner walls 422 on both sides to form the upper passage 431. That is, the upper passage 431 may be formed by the inner walls 422, the outer walls 421, and the top surface of the duct plate 41. In addition, when the top cover 50 is coupled, the top cover 50 may come into contact with the inner walls 422 and the outer walls 421 to complete the upper passage 431.

The pair of the outer walls 421 may be disposed on both left and right sides, and may extend from the front end to the rear end of the guide duct 40. In addition, rear ends of the outer walls 421 may be spaced apart from the inner walls 422 by a set distance. In addition, front ends of the outer walls 421 may pass through both left and right side ends of the second duct outlet 45 and extend to the front end of the guide duct 40. In addition, the guide duct 40 may be connected to the bent portion 413 extending upward along the perimeter of the guide duct 40.

With such a structure, the upper passage 431 may be formed to extend in the state of being branched state to both left and right sides at the rear end, and to be merged into one at the second duct outlet 45. In addition, the cold air introduced via the upper passage 431 may be supplied toward the rear surface of the freezing compartment door 22 at the front, that is, toward the door basket 221, without passing through the ice maker 30 covered by the duct plate 41.

In one example, at the front end of the upper passage 431, duct outlets 45 and 46 through which cold air flowing along the upper passage 431 is discharged may be formed. The duct outlets 45 and 46 may include the first duct outlet 46 and the second duct outlet 45 beneath the first duct outlet 46.

The first duct outlet 46 may be formed between the outer walls 421 and may be formed to open forward by the coupling of the guide duct 40 and the top cover 50. In addition, the second duct outlet 45 may be defined in front of the duct plate 41 and at the rear of a connection portion 451 for connecting lower ends of the outer walls 421 to each other. The connection portion 451 may be in contact with and coupled to the casing top surface 311.

The first duct outlet 46 may open forward and discharge cold air toward the rear surface of the freezing compartment door 22, and the second duct outlet 45 may open downward and be in communication with the casing outlet 313 via the casing passage 316. Therefore, the second duct outlet 45 may guide the cold air discharged via the guide duct 40 downward. As a result, as the cold air is discharged via the first duct outlet 46 and the casing outlet 313, even though at least a portion of the discharge port 163 is covered by the ice maker 30, the same effect as the cold air being discharged from most of the front surface of the ice maker 30 may be expected, and the cold air may be evenly supplied to the door basket 221 and food accommodated in the door basket 221.

In one example, the guide wall 42 may protrude from the top and bottom surfaces of the duct plate 41. In particular, a rear end of the guide wall 42 may have a structure extending both upwardly and downwardly with respect to the duct plate 41. Accordingly, an upper passage inlet 431*a* and a lower passage inlet 432*a* may be defined at the rear end of the guide duct 40 based on a rear end 145 of the duct plate 41.

Specifically, the rear ends of the inner walls 422 and the outer walls 421 may extend both upwardly and downwardly with respect to the duct plate 41. That is, respective portions of the inner walls 422 and the outer walls 421 may extend downwardly of the duct plate 41. In this regard, the inner walls 422 may extend downward along the cutout 44, but no longer protrude downward in front of the cutout 44. In addition, the outer walls 421 may also extend in the front and rear direction only within a length corresponding to the cutout 44, and define the lower passage inlet 432*a* through which the cold air may flow into the lower passage 432.

Lower ends of the outer wall 421 and inner wall 422 may be connected to each other by a lower connection portion 416. Accordingly, the lower passage inlet 432*a* may be defined by the outer wall 421 and the inner wall 422, the bottom surface of the duct plate 41, and the lower connection portion 416.

The lower passage inlet 432*a* may protrude downward with respect to the rear end 415 of the duct plate 41, and may be inserted into the casing recessed portion 317 defined at the rear end of the casing top surface 311. In the state in which the guide duct 40 is coupled to the ice maker 30, the lower passage inlet 432*a* may correspond to a space above the ice maker 30 corresponding to the position of the cell C.

Specifically, outer ends of the respective lower passage inlets 432*a* disposed on both left and right sides may be located on the same extension line as or located slightly outward of outer ends of the respective cells C located on both left and right side ends among the plurality of cells C arranged in succession horizontally. Thus, the cold air introduced into the lower passage 432 through the lower passage inlet 432*a* may cool all of the cells C on the top surface of the ice maker 30.

The cold air introduced into the lower passage inlets 432*a* located on both sides may be introduced into a space between the top surface of the ice maker 30 and the duct plate 41. The cold air inside the lower passage 432 may evenly cool top surfaces of the cells C. In particular, the shape of the lower passage 432 directs the cold air introduced from both sides toward the center, so that top surfaces of the cells C on both left and right sides as well as a top surface of the cell C in the middle covered by the water supply member 39 may be evenly cooled. An outlet of the lower passage 432 may not be separately defined in the guide duct 40, and therefore, the cold air may effectively cool a periphery of the cells C while staying inside the lower passage 432, that is, in the space between the bottom surface of the duct plate 41 and the top surface of the ice maker 30 for a sufficient time.

In addition, the cold air above the ice maker 30 may flow into the inner space of the casing peripheral surface 312 via the casing openings defined on both left and right sides of the cells C. Therefore, the cold air that has cooled the top surface of the upper tray 34 may flow downward via the openings 318 and 319 to further cool the lower tray 33.

In one example, an auxiliary guide 452 may be further formed on a front portion of the bottom surface of the duct plate 41. The auxiliary guide 452 may extend in the front and rear direction from positions corresponding to outer ends of the respective cells C on both sides, and may allow the cold air introduced into the lower passage 432 to stay inside an area where the cells C are located without being dispersed to both sides.

Figure 14:
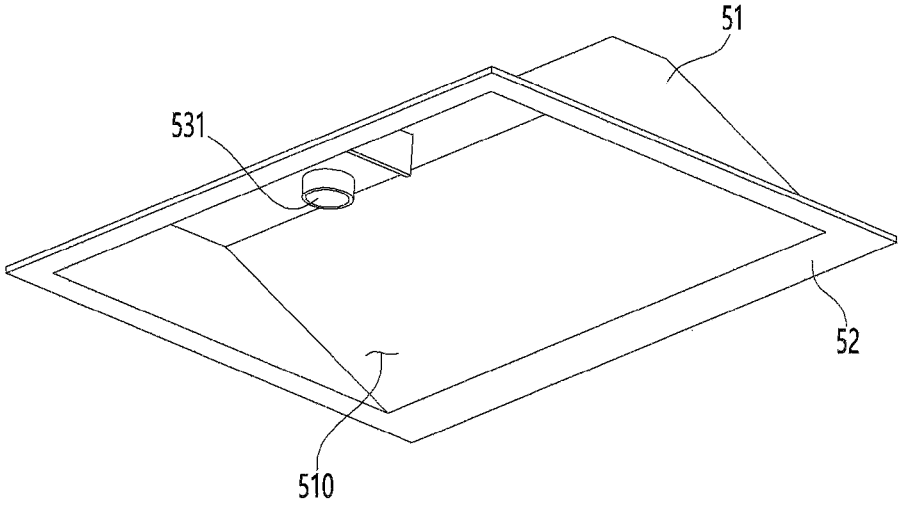
FIG. 14 is a rear-bottom perspective view of a top cover, which is one component of the ice making device.

FIG. 14 is a rear-bottom perspective view of a top cover, which is one component of the ice making device.

As shown in the drawing, the top cover 50 may be coupled to the guide duct 40 to shield the open top surface of the guide duct 40. The upper passage 431 may be completed by the coupling of the top cover 50 and the guide duct 40. In addition, the top cover 50 may be fixedly mounted on a bottom surface of the barrier 11, and may allow the ice making device 2 to be fixedly mounted inside the freezing compartment 13.

Specifically, the top cover 50 may be made of a plastic material and may include a plate-shaped cover plate 51 and a cover edge 52 formed along a perimeter of the cover plate 51.

The cover plate 51 may be formed in a shape corresponding to that of the guide duct That is, the cover plate 51 may be formed such that a central portion protrudes the most, and formed to be inclined or rounded downwardly in the forward and rearward directions with respect to the central portion. In addition, both left and right side surfaces of the cover plate 51 may be shielded. Accordingly, the top cover 50 may define a recessed space having an open bottom surface, and the guide duct 40 may be inserted into the space.

The cover plate 51 may shield the guide duct 40, and the upper passage 431 may be completed as an upper end of the guide wall 42 is in contact with a bottom surface of the cover plate 51.

In addition, a cover recessed portion 532 may be defined in the cover plate 51. The cover recessed portion 532 may be recessed at a position corresponding to the water supply member 39, and a cover opening 531 may be defined in the cover recessed portion 532 for the water supply pipe 54 to pass therethrough. The water supply pipe 54 inserted to pass through the cover opening 531 may extend to the water supply member 39 and supply water to the water supply member 39.

The cover edge 52 may extend outward along a lower end of the cover plate 51 and come into contact with the perimeter of the guide duct 40. The cover edge 52 may be coupled to the guide duct 40, and eventually, the ice maker 30, the guide duct 40, and the top cover 50 may be fixedly mounted on the bottom surface of the barrier 11 while being coupled to each other.

In addition, the cover edge 52 may come into contact with a perimeter of a barrier opening 102*a* defined in the bottom surface of the barrier 11. That is, the top cover 50 may be mounted such that the cover plate 51 is inserted into the barrier opening 102*a* and the cover edge 52 comes into close contact with the bottom surface of the barrier 11. Accordingly, in the state in which the ice making device 2 is mounted on the barrier 11, portions of the top cover 50 and the guide duct 40 may be located in an inner area of the barrier 11. In addition, the water supply pipe 54 guided into the barrier 11 may be mounted to pass through the cover opening 531 of the top cover 50.

In one example, the top cover 50 may be omitted when necessary, and the bottom surface of the barrier 11 may be recessed in the same shape as the top cover 50 and the guide duct 40 may be directly mounted on the barrier 11.

Hereinafter, an operation of the refrigerator 1 having the above structure will be described in more detail with reference to drawings.

Figure 15:
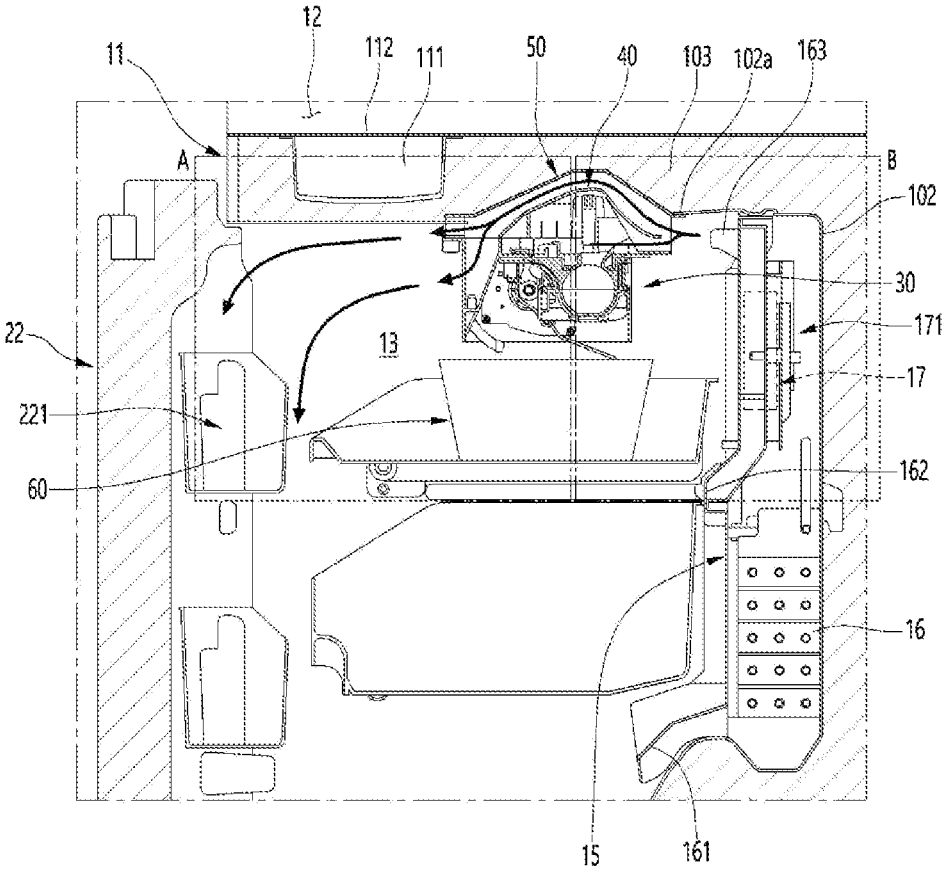
FIG. 15 is a cross-sectional view showing a flow state of cold air inside the freezing compartment.
Figure 16:
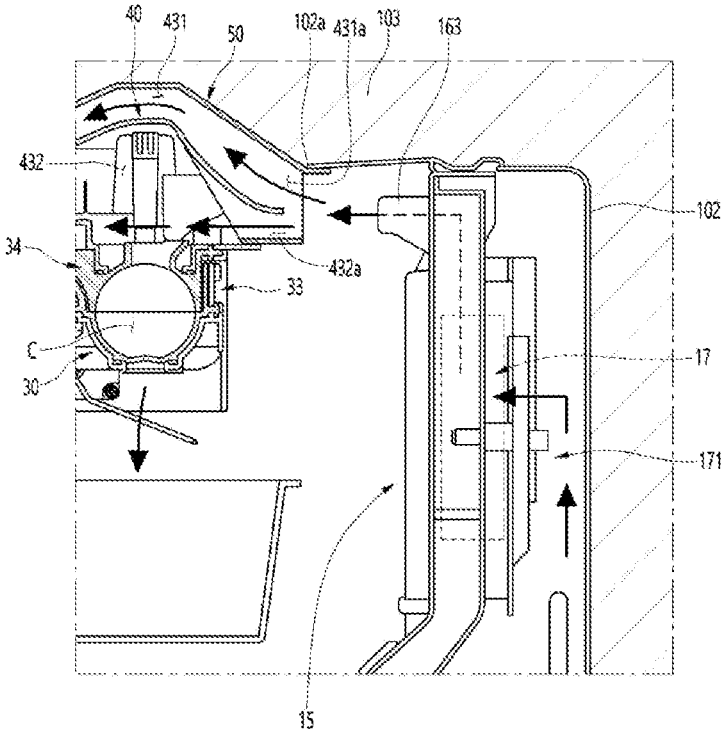
FIG. 16 is an enlarged view of a portion B in FIG. 15.
Figure 17:
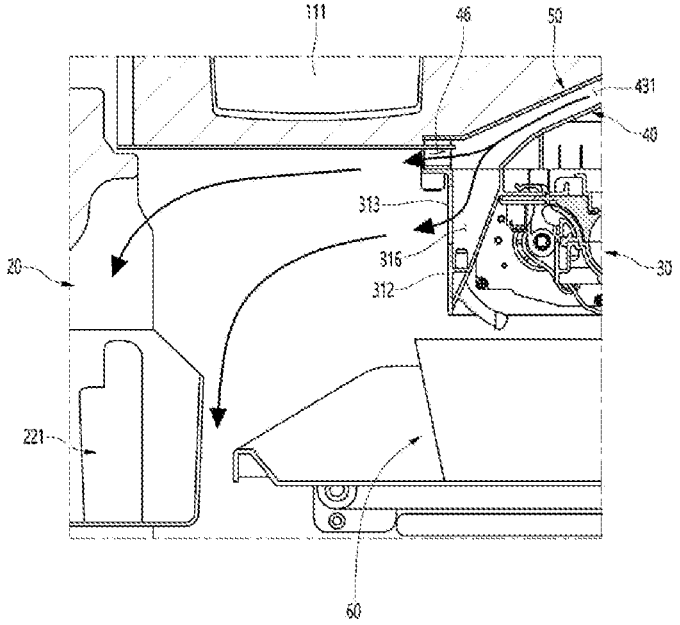
FIG. 17 is an enlarged view of a portion A in FIG. 15.

FIG. 15 is a cross-sectional view showing a flow state of cold air inside the freezing compartment. In addition, FIG. 16 is an enlarged view of a portion B in FIG. 15. In addition, FIG. 17 is an enlarged view of a portion A in FIG. 15.

As shown in the drawing, a refrigeration cycle may be driven to cool the freezing compartment 13, and cold air may be generated by heat exchange with ambient air in the evaporator 16. In such state, when the blowing fan 17 is operated, the cold air generated in the evaporator 16 may be discharged into the freezing compartment 13 via the discharge port 163, and air inside the freezing compartment 13 may be sucked via the suction port 161 and flow into the evaporator 16. By such circulation of cold air, the freezing compartment 13 may be cooled to a set temperature.

In one example, the ice maker 30 may be disposed in front of the discharge port 163. The ice maker 30 may be positioned between the rear surface of the door 20 and a front surface of the grille pan 15. In addition, when viewed from the front, the discharge port 163 may be covered by the ice making device 2.

The cold air discharged from the discharge port 163 may be supplied to the ice maker 30, and ice may be made in the ice maker 30 by the supplied cold air. In addition, a portion of the cold air discharged from the discharge port 163 may pass over the ice maker 30 by the guide duct 40 so as to be supplied to the rear surface of the freezing compartment door 22 and the door basket 221.

In particular, even in the situation in which the ice maker 30 is disposed in the horizontal direction and covers the discharge port 163, the cold air that has bypassed the ice maker 30 by the guide duct 40 may be smoothly supplied toward the rear surface of the freezing compartment door 22 and the door basket 221 from the front surface of the ice maker 30.

This will be described in more detail. As shown in FIG. 16, the cold air discharged from the discharge port 163 by the driving of the blowing fan 17 is directed forward. In addition, the cold air may flow into the upper passage inlet 431*a* and the lower passage inlet 432*a* adjacent to the discharge port 163. That is, because the discharge port 163 may be disposed to face the upper passage inlet 431*a* and the lower passage inlet 432*a*, most of the cold air discharged from the discharge port 163 may flow into the guide duct 40.

The upper passage inlet 431*a* and the lower passage inlet 432*a* may be defined adjacent to each other, and may be defined vertically with respect to the duct plate 41. Accordingly, the cold air discharged from the discharge port 163 may be divided at the rear end of the duct plate 41, a portion of the cold air may flow into the upper passage 431, and the remaining portion of the cold air may flow into the lower passage 432.

The cold air supplied to the lower passage 432 cools an area corresponding to the upper portions of the cells C on the top surface of the ice maker 30. In addition, the cold air may entirely cool the ice tray 35 by being discharged into the casing peripheral surface 312 via the casing openings 318 and 319 of the casing top surface 311.

The ice maker 30 may cool the inside of the cell C by the cold air supplied to the lower passage 432 and make the spherical ice. When the spherical ice is made, the lower tray 33 may be rotated by the driver 32, and the ejector 36 and the lower ejector 38 may be operated. The ice inside the cell C may be transferred downward by the ejector 36 and the lower ejector 38, and stored in the ice bin 60.

The cold air supplied to the upper passage 431 may flow along the upper passage 431. The upper passage 431 may extend forward via an upper portion of the guide duct 40 without passing through the area of the ice maker 30, particularly, the positions where the cells C are formed, by the duct plate 41.

Specifically, the upper passage 431 creates the independent cold air flow path by the duct plate 41, the cover plate 51, and the guide wall 42. The cold air flowing forward along the upper passage 431 may be discharged by first duct outlet 46 and the second duct outlet 45 defined at the front end of the duct casing 31.

Specifically, the first duct outlet 46 may be defined by the connection portion 451 of the front end of the top cover 50 and the front end of the guide duct 40. In addition, the cold air flowing through the upper passage 431 may be discharged from the position corresponding to the front surface of the ice maker 30 toward the rear surface of the freezing compartment door 22 disposed at the front.

In addition, the second duct outlet 45 may be connected to the front end of the upper passage 431. Thus, the cold air flowing through the upper passage 431 may pass through the second duct outlet 45 and flow into the casing passage 316. In this regard, the cold air introduced into the casing passage 316 may be effectively guided to the casing outlet 313 via the casing passage 316.

The casing outlet 313 may be located below the first duct outlet 46 and may be defined to be long in the vertical direction. Accordingly, the air that has passed through the lower passage 432 may pass through the second duct outlet 45 and be supplied to the rear surface of the freezing compartment door 22 or the door basket 221 via the casing outlet 313.

In this regard, the casing outlet 313 may be defined to be vertically long to effectively cool an upper area of the rear surface of the freezing compartment door 22 including the door basket 221 from the front surface of the ice maker 30. In particular, although at least the portion of the discharge port 163 may be covered due to the arrangement of the ice maker 30, a double discharge structure of the first duct outlet 46 and the casing outlet 313 and the shape of extension of the casing outlet 313 in the vertical direction may allow the cold air to be effectively supplied toward the door basket 221 and the food accommodated in the door basket 221.

In one example, the ice maker 30 may be located at the rear of the barrier accommodation portion 111 defined in the barrier 11. That is, positions of the barrier accommodation portion 111 and the ice maker 30 may be spaced apart from each other in the front and rear direction.

Therefore, the barrier accommodation portion 111 and the upper end of the ice maker 30 may not interfere with each other, and therefore, an insulation performance may be prevented from deteriorating even when a thickness of the barrier 11 filled with the insulation material 103 is maintained, and loss of a storage capacity of the storage space may be prevented.

That is, the accommodation portion 111 may be disposed at a position convenient for use by the user without increasing the overall thickness of the barrier 11, and at the same time, the ice maker 30 and the accommodation portion 111 may be disposed so as not to overlap each other via the horizontal arrangement of the ice maker 30 to maintain the insulation performance.

INDUSTRIAL APPLICABILITY

Because the refrigerator according to the embodiment of the present disclosure may achieve the smooth supply of the cold air and improve the cooling performance, the refrigerator has high industrial applicability.

What is claimed is:

1. A refrigerator comprising:

a cabinet defining a storage space therein;

a door configured to open and close the storage space;

a grille panel provided at a side of the storage space, the grille panel including a discharge port configured to discharge cold air into the storage space; and an ice making device comprising:

an ice maker that is disposed at a side of the grille panel, the ice maker comprising an ice tray that defines a cell configured to receive water to make ice, and a guide duct configured to guide a flow of the cold air discharged from the discharge port, the guide duct comprising a duct plate that covers at least a portion of the ice maker, wherein the guide duct provides a branched passage to thereby guide (i) a first portion of the cold air discharged from the discharge port into the ice maker and (ii) a second portion of the cold air from the discharge port into the storage space, and wherein the branched passage comprises:

a first passage defined at a first side of the duct plate such that the first portion of the cold air flows along the first passage to a side of the ice tray, and a second passage defined at a second side of the duct plate such that the second portion of the cold air flows along the second passage to the storage space.

2. The refrigerator of claim 1, wherein the guide duct is disposed between a peripheral side of the storage space and the ice maker, so that a portion of the branched passage through which the second portion of the cold air is provided around the ice maker.

3. The refrigerator of claim 2, further comprising a cover that is disposed at the peripheral side of the storage space and has at least a recessed portion, and wherein the cover defines the portion of the branched passage by covering a portion of the guide duct.

4. The refrigerator of claim 1, wherein an inlet of the guide duct faces the discharge port, wherein an outlet of the guide duct faces a rear surface of the door and includes a plurality of outlets that are spaced apart from each other, and wherein at least one of the plurality of outlets of the guide duct faces a door basket disposed at the door.

5. The refrigerator of claim 1, wherein the ice maker further comprises a casing defining an outer appearance of the ice maker, wherein the ice tray is disposed inside the casing, and wherein the guide duct is coupled to the casing and covers a portion of the casing.

6. The refrigerator of claim 5, wherein a surface of the casing defines a casing outlet that is in fluid communication with the branched passage of the guide duct and that is configured to discharge the cold air from the branched passage toward the door.

7. The refrigerator of claim 1, wherein the guide duct further comprises a guide wall disposed along the duct plate to define the branched passage, wherein the first passage is defined by the guide wall and a first surface of the duct plate, and wherein the second passage is defined by the guide wall and a second surface of the duct plate, the second surface being opposite to the first surface.

8. The refrigerator of claim 7, wherein the guide duct defines a cutout configured to receive a water supply member configured to supply water to the ice maker, and wherein the guide wall is provided at both sides of the cutout, so that the branched passage is branched to both sides of the cutout.

9. The refrigerator of claim 7, wherein the guide duct includes:

a first duct outlet defined at a front end of the duct plate and configured to discharge cold air forward, and a second duct outlet extending through the duct plate and configured to discharge cold air downward, and wherein the ice maker provides a casing guide connected to the second duct outlet and configured to guide discharged cold air toward a door basket disposed at the door.

10. The refrigerator of claim 7, wherein the duct plate and the guide wall define the first passage and the second passage to have a plate shape.

11. The refrigerator of claim 1, wherein the duct plate covers at least a portion of an upper side of the ice maker, wherein the first passage is provided between the duct plate and the ice maker, wherein the second passage is provided at an upper side of the duct plate, and wherein the second portion of the cold air is guided to a front of the ice maker while bypassing the ice make.

12. A refrigerator comprising an ice making device, wherein the ice making device comprises:

an ice maker; and a guide duct configured to guide a flow of cold air discharged from a discharge port, wherein the guide duct comprises a duct plate that covers at least a portion of one surface of the ice maker, the duct plate having a first surface and a second surface opposite to the first surface, wherein the duct guide has:

a first duct inlet configured to receive a first portion of the cold air discharged from the discharge port such that the first portion of the cold air flows between the first surface of the duct plate and the ice maker to thereby be supplied into the ice maker, and a second duct inlet configured to receive a second portion of the cold air discharged from the discharge port such that the second portion of the cold air flows along the second surface of the duct plate and is supplied to a space defined at a front side of the ice maker, wherein the ice maker comprises a casing, wherein a surface of the casing includes a portion shielded by the guide duct, and wherein the first portion of the cold air flows between the casing and the duct plate.

13. The refrigerator of claim 12, wherein the discharge port is not visible by being covered by the ice maker.

14. The refrigerator of claim 12, wherein the ice maker is disposed in front of the discharge port, and wherein the first duct inlet and the second duct inlet face the discharge port.

15. The refrigerator of claim 12, wherein the ice maker further comprises an ice tray that is disposed inside the casing and defines a cell configured to receive water to make ice, and wherein the guide duct is coupled to the casing.

16. The refrigerator of claim 15, wherein, based on coupling of the guide duct and the casing, a first passage is provided at a first side of the duct plate and a second passage is formed provided at a second side of the duct plate, and wherein the first portion of the cold air flows along the first passage, and the second portion of the cold air flows along the second passage.

17. The refrigerator of claim 15, wherein a surface of the casing defines a casing outlet that is in communication with a passage of the guide duct and that is configured to discharge the second portion of the cold air discharged from the discharge port.

18. The refrigerator of claim 17, wherein a casing guide is provided at a front surface of the casing, wherein a first duct outlet and a second duct outlet are formed in front of the duct plate, wherein a portion of the first portion of the cold air is discharged to the front side of the ice maker, and a remaining portion of the first portion of the cold air is discharged through the second duct outlet, and wherein a cold air discharged through the second duct outlet is guided by the casing guide and discharged through the casing outlet.

19. The refrigerator of claim 12, wherein the guide duct further comprises a guide wall disposed along the duct plate, wherein the first portion of the cold air flows along a first passage defined by the guide wall and the first surface of the duct plate, and wherein the second portion of the cold air flows along a second passage defined by the guide wall and the second surface of the duct plate.

20. The refrigerator of claim 19, wherein the guide duct defines a cutout configured to receive a water supply member configured to supply water to the ice maker, and wherein the guide wall is provided at both sides of the cutout.

* * * * *